US006050860A

United States Patent [19]

Tsuchiya

[11] Patent Number: 6,050,860

[45] Date of Patent: Apr. 18, 2000

[54] TERMINAL LOCKING STRUCTURE

[75] Inventor: Shinichi Tsuchiya, Shizuoka, Japan

[73] Assignee: Yazaki Corporation, Tokyo, Japan

[21] Appl. No.: 08/932,531

[22] Filed: Sep. 17, 1997

[30] Foreign Application Priority Data

Sep. 17, 1996 [JP] Japan ..... 8-245150

[51] Int. Cl.[7] ..... H01R 13/432

[52] U.S. Cl. ..... 439/748; 439/746

[58] Field of Search ..... 439/748, 746, 439/747, 749, 872

[56] References Cited

U.S. PATENT DOCUMENTS

| | | | |
|---|---|---|---|
| 3,808,589 | 4/1974 | Bonhomme | 439/747 |
| 4,030,804 | 6/1977 | Enomoto | 439/872 |
| 4,371,227 | 2/1983 | Yosimura | 439/746 |
| 5,624,273 | 4/1997 | Myer | 439/748 |

FOREIGN PATENT DOCUMENTS

| | | |
|---|---|---|
| 0547396 | 6/1993 | European Pat. Off. . |
| 1665164 | 9/1971 | Germany . |
| 2628167 | 1/1978 | Germany . |
| 3147282 | 6/1991 | Japan . |

*Primary Examiner*—Paula Bradley
*Assistant Examiner*—Katrina Davis
*Attorney, Agent, or Firm*—Sughrue, Mion, Zinn, Macpeak & Seas, PLLC

[57] ABSTRACT

In the terminal locking structure, a free end of a flexible terminal is engaged with an engagement portion in a connector housing to thereby lock a terminal at a predetermined position in the connector housing. A short protection piece extends along an inclined surface of the terminal lance so as to protect a root portion of the terminal lance bent from a rear end of a box ceiling plate which abuts on an upper side of a plate piece from which the terminal lance is bent.

4 Claims, 5 Drawing Sheets

TERMINAL LOCKING STRUCTURE

BACKGROUND OF THE INVENTION

The present invention relates to a terminal locking structure in which a terminal lance is prevented from being deformed when a terminal of an electric connector is removed from a connector housing.

Heretofore, various structures disclosed, for example, in Japanese Patent Unexamined Publication No. Hei. 3-147282, are known as terminal locking structures of electric connectors. As shown in FIG. 5, in a terminal locking structure 31 of a conventional electric connector 40, a first free end 35*a* of a flexible terminal lance 35 made of a metal plate is engaged with an engagement portion 33 in a connector housing 32 to thereby lock a terminal 34 at a predetermined position in the connector housing 32. The terminal lance 35 of the terminal 34 is made of a metal plate integrated with a box ceiling plate 36 so as to be bent at a desired angle obliquely backward and outward.

A flexible contact plate 39 which cooperates with the box ceiling plate 36 to press and hold a mating contact 50 for the electric connector 40 to thereby electrically connect the maiting contact 50 to the electric connector 40, is bent integrally with a bottom plate 38. An end plate at the first free end 35*a* of the terminal lance 35 is punched in its center, bent downward and further bent so as to be parallel with the bottom plate 38, so that a second free end 35*c* is formed. The second free end 35*c* abuts on a stopper plate 37 supported by a stabilizer 41 of the terminal 34, so that the terminal lance 35 is prevented from projecting out due to its flexibility over a necessary extent. An electric wire caulking portion 42 is provided in the rear portion of the terminal 34 in order to fix an electric wire W and to make electrical connect with a core of the electric wire W.

An unlock hole 45 for removing the terminal 34 is provided under a ceiling 44 of the connector housing 32 at the upper position of the box ceiling plate 36 of the terminal lance 35. Further, an insertion hole 47 for leading the mating contact 50 therein is provided in the front wall 46 of the connector housing 32 whereas a slot 49 for preventing the mis-insertion of the terminal 34 is provided in the center portion of the bottom wall 48.

In the thus configured terminal locking structure 31, when the terminal 34 with the electric wire W caulked by the electric wire caulking portion 42 in the rear is inserted into the connector housing 32 while being slid along the bottom wall 48 and the slot 49 from the rear of the connector housing 32, the terminal lance 35 projecting upward abuts on a rear end portion 44*a* of the ceiling 44 so as to be moved down while being pressed. When the terminal 34 is further inserted, the first free end 35*a* of the terminal lance 35 passes through the engagement portion 33 so that not only the terminal lance 35 is restored to its original state but also the first free end 35*a* is locked in the front end surface of the engagement portion 33. Accordingly, not only the terminal 34 is locked at a predetermined position in the connector housing 32 but also the front portion of the terminal is positioned by the front wall 46.

When the mating contact 50 is inserted into the insertion hole 47 in the front portion of the connector housing 32, the mating contact 50 is held between the contact plate 39 and the box ceiling plate 36 so that the electric wire W is electrically connected to the mating contact 50.

In the above conventional terminal locking structure 31, to take out the terminal 34 from the connector housing 32, when an unlock jig J is inserted through the unlock hole 45 so as to be brought into contact with the inclined surface of the terminal lance 35 or the vicinity of the first free end 35*a* in the direction of the arrow B to thereby press down the terminal lance 35, the first free end 35*a* is disengaged from the engagement portion 33. Accordingly, when the rear end portion of the terminal 34 is pulled back, the terminal 34 can be removed from the connector housing 32.

In this occasion, however, if the inside of the unlock hole 45 cannot be seen so that the unlock jig J is entangled, a root portion 35*b* of the terminal lance 35 may be deformed by the unlock jig J. Accordingly, there arises a problem that the terminal lance 35 is plastically deformed to spoil its function.

SUMMARY OF THE INVENTION

Upon such circumstances, an object of the present invention is to provide a terminal locking structure in which a root portion of a terminal lance can be prevented from being deformed so that the function of the terminal lance is not spoiled even in the case where the terminal lance is entangled by an unlock jig when a terminal is removed from a connector housing.

In order to achieve the above object, according to an aspect of the present invention, provided is a terminal locking structure of an electric connector in which a free end of a flexible terminal lance is engaged with an engagement portion in a connector housing to thereby lock the terminal at a predetermined position in the connector housing, wherein a short-size protection piece is extended along an inclined surface of the terminal lance from a rear end of a box ceiling plate which abuts on an upper side of a plate piece of the terminal from which the terminal lance is bent at a predetermined angle obliquely backward and outward.

In the thus configured terminal locking structure, because the short-size protection piece is extended along the inclined surface of the terminal lance from the rear end of the box ceiling plate which abuts on the upper side of the plate piece of the terminal from which the terminal lance is bent at a desired angle obliquely backward and outward, the terminal lance is not plastically deformed even in the case where the terminal lance is entangled by the unlock jig when the terminal is removed from the connector housing. Accordingly, the function of the terminal lance is not spoiled, so that reliability of the terminal can be improved.

DETAILED DESCRIPTION OF THE INVENTION

Figure 1:
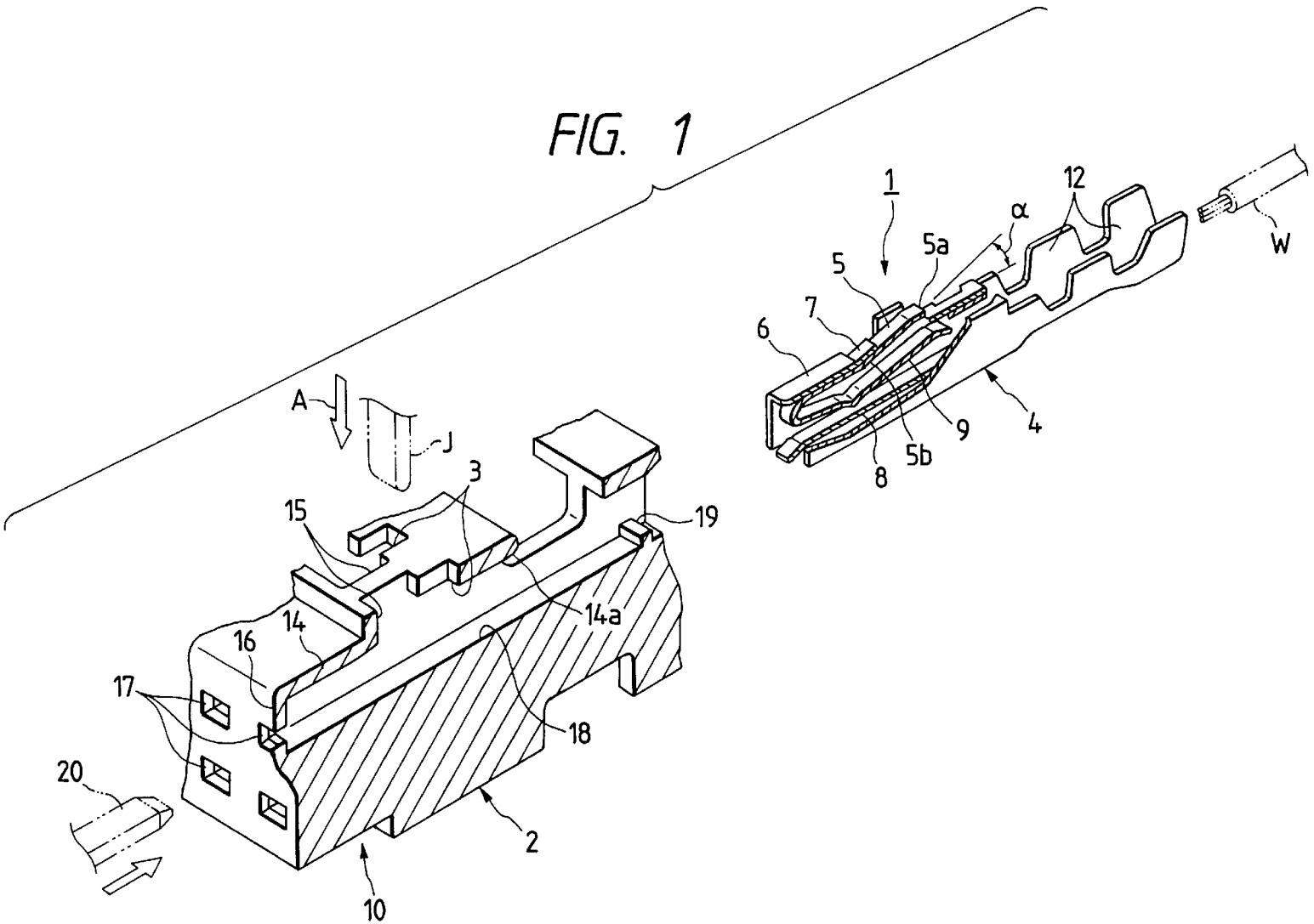
FIG. 1 is an exploded perspective view showing a first embodiment of a terminal locking structure according to the present invention.
Figure 2:
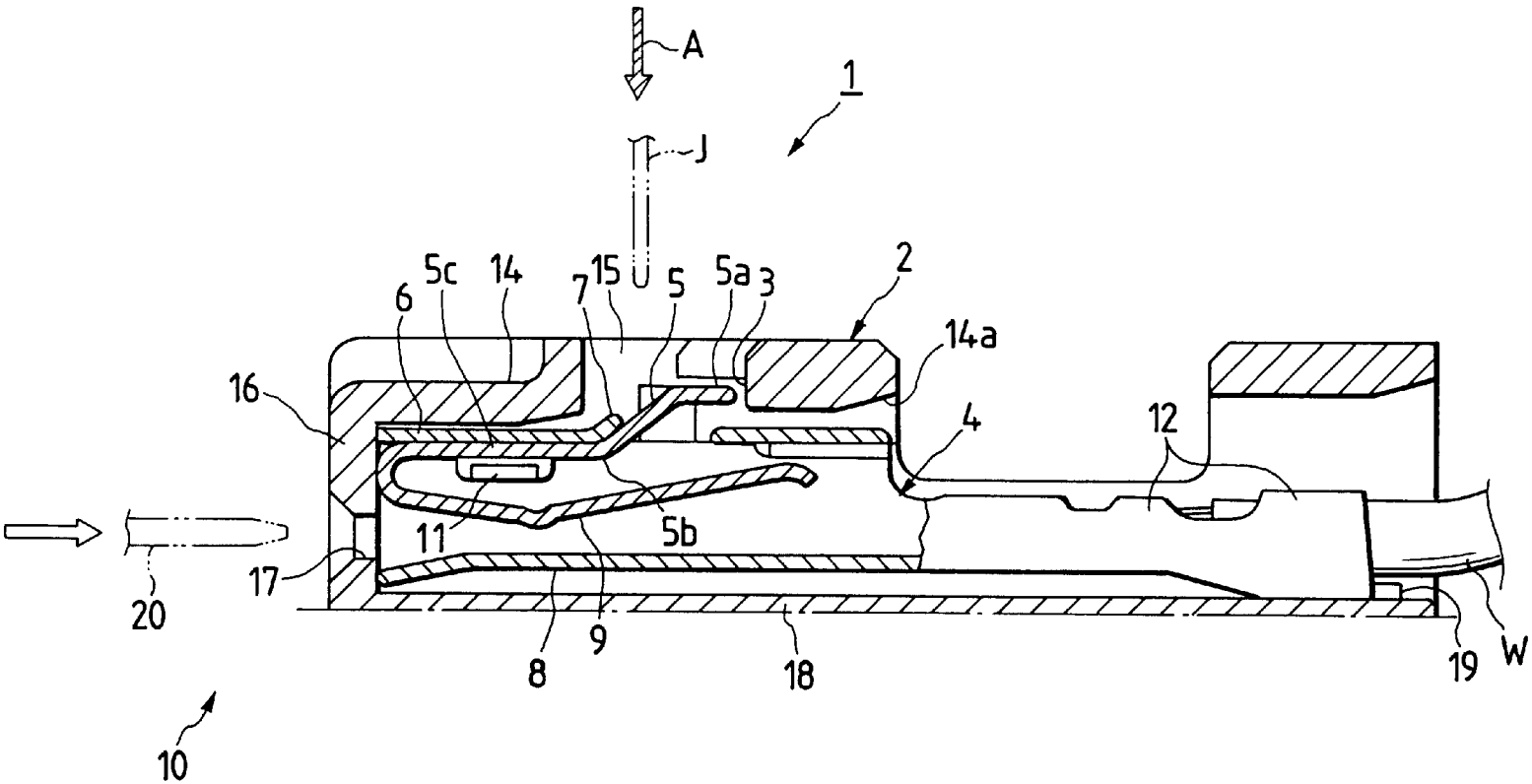
FIG. 2 is a vertical sectional view of the terminal locking structure shown in FIG. 1.
Figure 3:
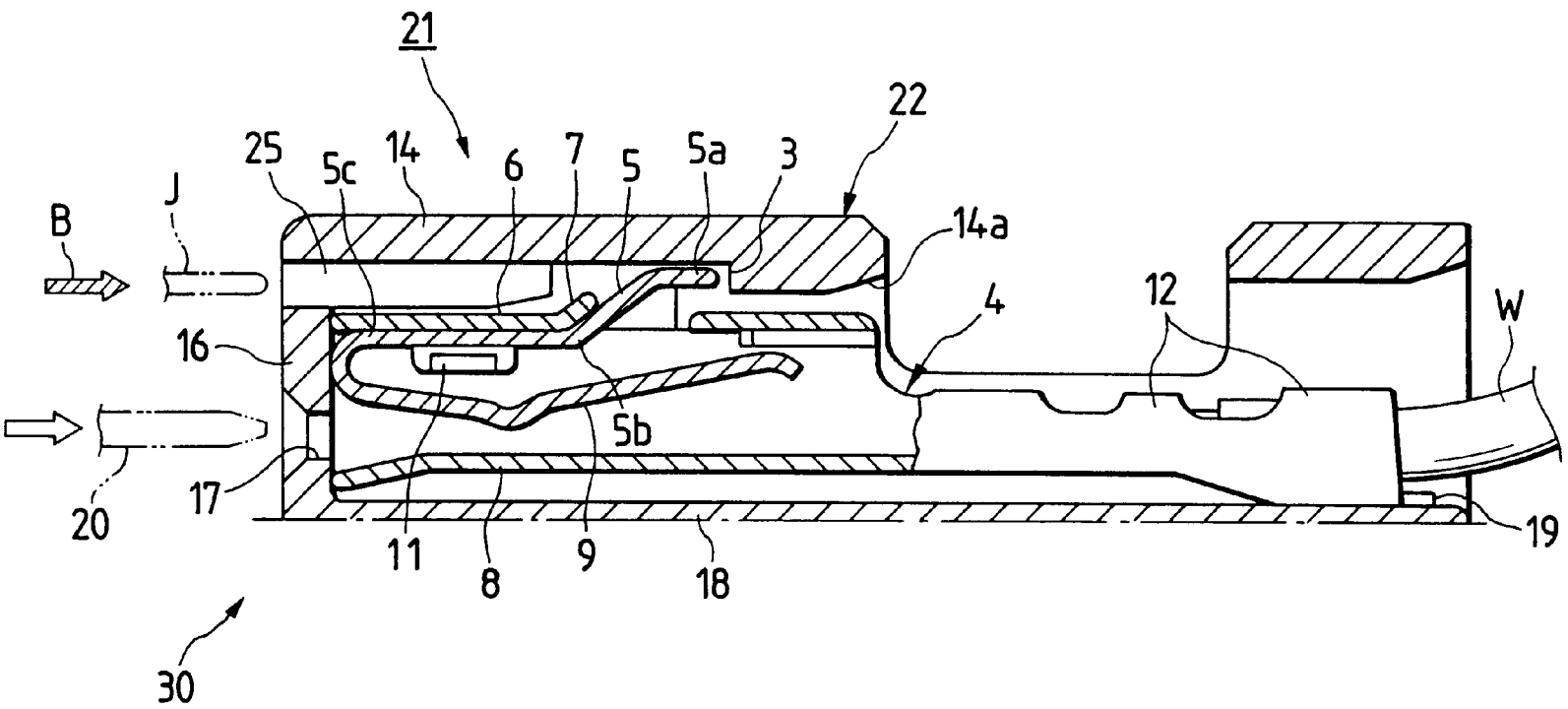
FIG. 3 is a vertical sectional view showing a second embodiment of the terminal locking structure according to the present invention.

Preferred embodiments of a terminal locking structure according to the present invention will be described below in detail with reference to FIGS. 1 through 4. FIG. 1 is an exploded perspective view showing a first embodiment of the terminal locking structure according to the present invention; FIG. 2 is a vertical sectional view of the terminal locking structure shown in FIG. 1; FIG. 3 is a vertical sectional view showing a second embodiment of the terminal locking structure according to the present invention; and FIGS. 4(*a*) to 4(*c*) are partly enlarged sectional views of a protection piece and its vicinity in FIGS. 2 and 3.

As shown in FIGS. 1 and 2, in a terminal locking structure 1 of an electric connector 10 in the first embodiment, a free end 5*a* of a flexible terminal lance 5 formed of a metal plate is engaged with an engagement portion 3 in a connector housing 2, so that a terminal 4 is locked at a predetermined position in the connector housing 2. A box ceiling plate 6 in the terminal 4 abuts on the upper side of a plate piece 5*c* from which the terminal lance 5 is bent at a desired angle α obliquely backward and outward. A short-size protection piece 7 is extended from the rear end of the box ceiling plate 6 so as to be along an inclined surface from a root portion 5*b* of the terminal lance 5.

The terminal lance 5 is folded so as to be integrated with a flexible contact plate 9 which serves to catch a mating contact 20 in the connector housing 2 to thereby make electrical connection. The plate piece 5*c* of the terminal lance 5 abuts on the lower side of the box ceiling plate 6 and is fixed by a support plate 11 which is cut so as to be erected from a side wall of the terminal. Further, an electric wire caulking portion 12 is provided in the rear portion of the terminal 4 in order to fix a coated electric wire W and fix and electrically connect a core wire.

An unlocking hole 15 for removing the terminal 4 is provided in a ceiling 14 of the connector housing 2 so as to be located above the terminal lance 5. Insertion holes 17 for leading mating contacts 20 therein are provided in the front wall 16 of the connector housing 2. A lock protrusion 19 for preventing the terminal 4 from being dislocated backward is provided in the rear end portion of the bottom wall 18 of the connector housing 2.

Figure 4A:
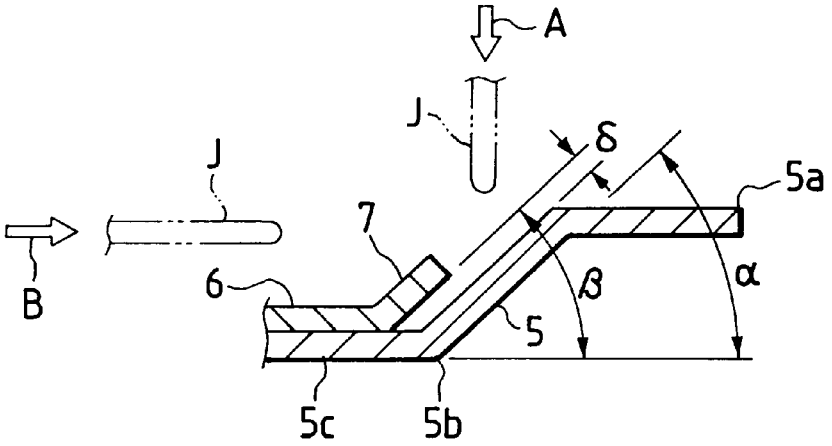
FIGS. 4(*a*) to 4(*c*) are partly enlarged sectional views of a protection piece and its vicinity in FIGS. 2 and 3.
Figure 4B:
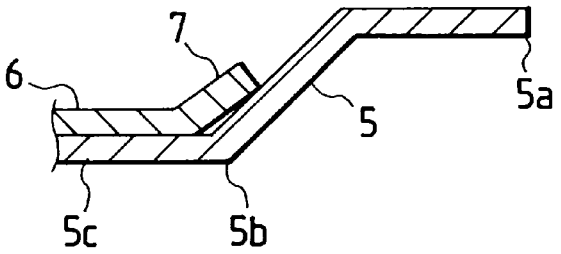
Figure 4C:
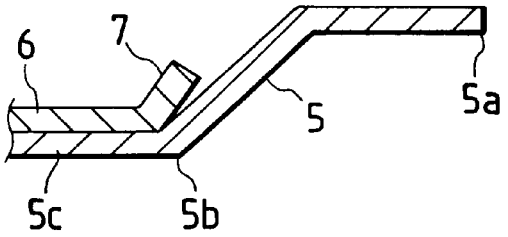
Figure 5:
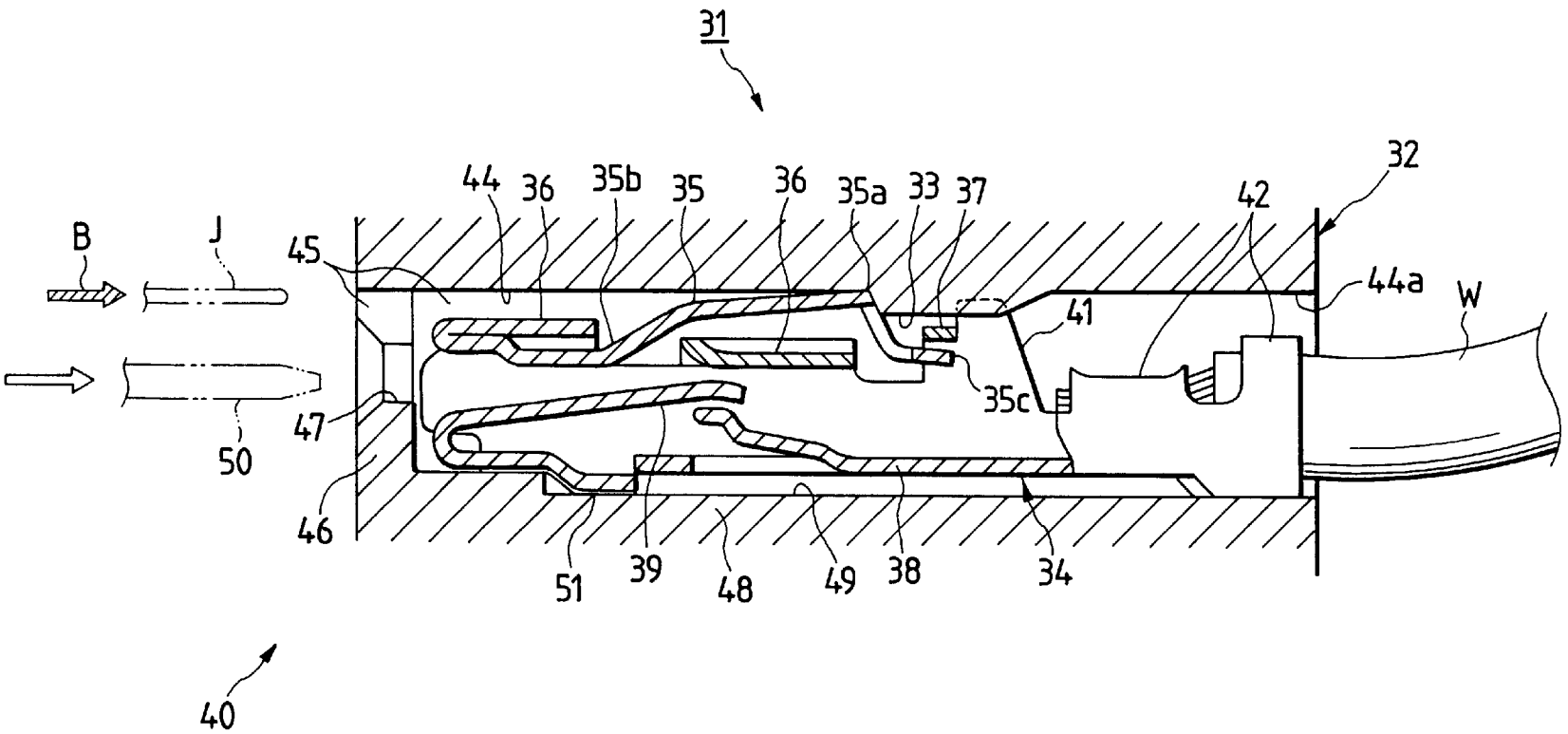
FIG. 5 PRIOR ART
FIG. 5 is a vertical sectional view showing an example of a conventional terminal locking structure.

As shown in FIG. 4(*a*), the terminal lance 5 is provided so as to project obliquely backward and outward at an angle a with respect to the plate piece 5*c*. An angle β between the box ceiling plate 6 and the protection piece 7 extended along the terminal lance 5 at the rear end of the box ceiling plate 6 is set to be substantially equal to the angle α. As shown in FIGS. 4(*b*) and 4(*c*), the protection piece 7 need not be always parallel with the terminal lance 5.

When the gap δ between the protection piece 7 and the terminal lance 5 is large as shown in FIG. 4(*a*), the protection piece 7 cannot fulfill its function. Therefore, the gap δ need not be provided. Accordingly, the bending angle β of the protection piece 7 is allowed to vary more or less in terms of accuracy of finishing.

In the thus configured terminal locking structure 1, when the terminal 4 with the electric wire W caulked by the electric wire caulking portion 12 is inserted from the rear of the connector housing 2 while being slid on the bottom wall 18, the terminal lance 5 projecting upward abuts on the rear end portion 14*a* of a ceiling 14 so as to be pushed down while being pressed. When the terminal 4 is further inserted, the free end 5*a* of the terminal lance 5 passes through the engagement portion 3, so that the terminal lance 5 is restored to its original state. Furthermore, the free end 5*a* is engaged with the front end surface of the engagement portion 3, so that the terminal 4 is locked at a predetermined position in the connector housing 2. In this occasion, the rear end surface of the terminal 4 is locked by the lock protrusion 19, so that not only the terminal 4 is prevented from being dislocated backward but also the front portion of the terminal 4 is positioned by the front wall 16.

When the mating contact 20 is inserted into the insertion holes 17 in the front portion of the connector housing 2, the mating contact 20 is held between the contact plate 9 and the bottom plate 8, so that the terminal 4 is electrically connected to the mating contact 20.

To remove the terminal 4 from the connector housing 2, when an unlocking jig J is inserted in the direction of the arrow A as shown in FIG. 2 so as to be brought into contact with the inclined surface or free end 5*a* of the terminal lance 5 to thereby press down the terminal lance 5, the free end 5*a* is disengaged from the engagement portion 3. Accordingly, when the rear end portion of the terminal 4 is pulled back while lifted up so as to be departed from the lock protrusion 19, the terminal 4 can be removed from the connector housing 2 easily.

In this occasion, because the root portion 5*b* of the terminal lance 5 is protected by the protection piece 7, the root portion 5*b* is never deformed even in the case where the inside of the unlock hole 15 cannot be seen so that the unlock jig J is entangled. Accordingly, the terminal lance 5 is not plastically deformed, so that its function is not spoiled. Accordingly, improvement of reliability of the terminal 4 can be attained.

As shown in FIG. 3, in a terminal locking structure 21 of an electric connector 10 according to a second embodiment of the present invention, unlike the first embodiment, an unlock hole 25 provided in a connector housing 22 is disposed in a front wall 16. Parts similar to those of the configuration in the first embodiment are designated by the same reference numerals so that the detailed description of the parts will be omitted.

In the thus configured terminal locking structure 21, to remove the terminal 4 from the connector housing 22, the unlock jig J is inserted through the unlock hole 25 in the direction of the arrow B so as to be brought into contact with the inclined surface of the terminal lance 5 to thereby move down the terminal lance 5. Then, the free end 5*a* is disengaged from the engagement portion 3. Accordingly, when the rear end portion of the terminal 4 is pulled back while lifted up so as to be departed from the lock protrusion 19, the terminal 4 can be removed from the connector housing 22 easily.

In this, occasion, because the root portion 5*b* of the terminal lance 5 is protected by the protection piece 7, the root portion 5*b* is never deformed even in the case where the inside of the unlock hole 25 is lost to sight so that the unlock jig J is entangled. Accordingly, the terminal lance 5 is not plastically deformed, so that its function is not spoiled. Accordingly, improvement of reliability of the terminal 4 can be attained.

The present invention is not limited to the aforementioned embodiments but suitable changes may be made for carrying out the invention in other modes. For example, though the terminal 4 in the first and second embodiments is a female terminal, the present invention may be also applied to a male terminal.

As described above, in the terminal locking structure according to the present invention, the short-size protection piece is extended along the inclined surface of the terminal lance from the rear end of the box ceiling plate which abuts on the upper side of plate piece of the terminal from which the terminal lance is bent at a desired angle obliquely backward and outward.

Accordingly, the terminal lance is not plastically deformed even in the case where the terminal lance is entangled by the unlock jig when the terminal is removed from the connector housing. Accordingly, the function of the terminal lance is not spoiled, so that reliability of the terminal can be improved.

What is claimed is:

1. A terminal locking structure of an electrical connector in which a free end of a flexible terminal lance is engaged with an engagement portion in a connector housing to thereby lock a terminal in a predetermined position in said connector housing, characterized in that a protection piece having an inclined surface in contact with and extending along an inclined surface of a root portion of said terminal lance so as to protect said terminal lance from being bent inadvertently.

2. A terminal of an electrical connector, comprising:

a flexible terminal lance having a free end engaged with an engagement portion of a connector housing to thereby lock said terminal in said connector housing;

a plate piece from which said terminal lance extends;

a box ceiling plate which abuts on an upper side of said plate piece; and a protection piece having an inclined surface in contact with and extending along an inclined surface of a root portion of said terminal lance so as to protect said terminal lance from being bent inadvertently, said protection piece being continuous with said box ceiling plate.

3. The terminal locking structure of claim 1, wherein said protection piece extends only partially along said terminal lance.

4. The terminal of claim 2, wherein said protection piece extends only partially along said terminal lance.

* * * * *